US007368653B2

(12) United States Patent
Shibukawa et al.

(10) Patent No.: US 7,368,653 B2
(45) Date of Patent: May 6, 2008

(54) ELECTRONIC MUSICAL APPARATUS AND PROGRAM FOR CONTROLLING THE SAME

(75) Inventors: Takeo Shibukawa, Shizuoka-ken (JP); Tsutomu Yanase, Hamamatsu (JP)

(73) Assignee: Yamaha Corporation (JP)

( * ) Notice: Subject to any disclaimer, the term of this patent is extended or adjusted under 35 U.S.C. 154(b) by 331 days.

(21) Appl. No.: 11/031,324

(22) Filed: Jan. 7, 2005

(65) Prior Publication Data

US 2005/0150363 A1 Jul. 14, 2005

(30) Foreign Application Priority Data

Jan. 8, 2004 (JP) ..... 2004-003218
Jan. 8, 2004 (JP) ..... 2004-003219

(51) Int. Cl.
*G10H 5/00* (2006.01)

(52) U.S. Cl. ..... 84/653; 715/777

(58) Field of Classification Search ..... 84/653; 715/777

See application file for complete search history.

(56) References Cited

U.S. PATENT DOCUMENTS 5,623,591 A * 4/1997 Cseri ..... 715/762
5,745,716 A * 4/1998 Tchao et al. ..... 715/777
6,192,258 B1 * 2/2001 Kamada et al. ..... 455/566
6,323,883 B1 * 11/2001 Minoura et al. ..... 715/784
6,520,410 B2 * 2/2003 Putman et al. ..... 235/380
6,538,998 B1 * 3/2003 Garimella ..... 370/241
6,600,930 B1 * 7/2003 Sakurai et al. ..... 455/414.3
6,654,950 B1 * 11/2003 Barnishan ..... 717/136
6,667,751 B1 * 12/2003 Wynn et al. ..... 715/833
6,691,138 B1 * 2/2004 Kirkpatrick et al. ..... 707/204
6,741,268 B1 * 5/2004 Hayakawa ..... 715/777
6,842,877 B2 * 1/2005 Robarts et al. ..... 715/708
7,098,392 B2 * 8/2006 Sitrick et al. ..... 84/477 R
7,106,298 B1 * 9/2006 Turner et al. ..... 345/156
7,122,731 B2 * 10/2006 Isozaki ..... 84/615
2002/0081997 A1 * 6/2002 Morishima ..... 455/412
2002/0174202 A1 * 11/2002 Kohyama et al. ..... 709/220
2003/0153992 A1 * 8/2003 Maruyama et al. ..... 700/83

FOREIGN PATENT DOCUMENTS

JP 2002-152328 A 5/2002
JP 2002-328770 A 11/2002
JP 2003-157074 A 5/2003
JP 2003-255934 A 9/2003

* cited by examiner

*Primary Examiner*—Lincoln Donovan
*Assistant Examiner*—Christina Russell
(74) *Attorney, Agent, or Firm*—Rossi, Kimms & McDowell, LLP

(57) ABSTRACT

An electronic musical apparatus in which operators for changing pages on a musical instrument function-related screen and history pages on a Web screen are shared, so that those pages can be changed using similar operating systems to improve the userfriendliness. A display controller 38 is operable when the Web screen is displayed by the display 19, to change the history pages of the Web screen forward in terms of time in response to operation of a Next switch 47, and the display controller 38 is operable when the Web screen is displayed by the display 19, to change the history pages of the Web screen backward in terms of time in response to operation of a Back switch 48.

11 Claims, 6 Drawing Sheets

*FIG. 6*

| SWITCH | MUSICAL INSTRUMENT MODE | BROWSER MODE |
|---|---|---|
| Back (48) | MOVE TO LEFT ADJACENT TAB | RETURN TO LAST HISTORY |
| Next (47) | MOVE TO RIGHT ADJACENT TAB | GO TO NEXT HISTORY |
| ENTER (50) | LISTEN TO TONE COLOR DEMONSTRATION | ENTER (SET) |
| : | : | : |

ELECTRONIC MUSICAL APPARATUS AND PROGRAM FOR CONTROLLING THE SAME

BACKGROUND OF THE INVENTION

1. Field of the Invention

The present invention relates to an electronic musical apparatus which has a Web (World Wide Web) browser function and causes a display to display a musical instrument function-related screen (hereinafter also referred to as "musical instrument function-related page") and a Web screen (hereinafter also referred to as "Web page") which is obtained via a communication network, as well as a program for controlling the electronic musical apparatus.

2. Description of the Related Art

Conventionally, as disclosed in e.g. Japanese Laid-Open Patent Publication (Kokai) No. 2002-328770, an electronic musical apparatus such as an electronic musical instrument has been known which causes a display section such as a liquid crystal display to display a "musical instrument function-related screen" such as a setting/selecting screen, which consists of a plurality of pages and is related to musical instrument functions (the first prior art). In this electronic musical apparatus, in the case where a musical instrument function-related page such as a tone color selecting screen and a song data selecting screen cannot be displayed on one screen, due to a large number of tone colors and a large number of song data, the musical instrument function-related page is divided into a plurality of pages according to e.g. tone color groups, and any of tabs attached to the respective pages is selected to display a desired page so that a specific tone color or others can be selected on the displayed page.

Also, as disclosed in Japanese Laid-Open Patent Publication (Kokai) No. 2003-255934, an electronic musical apparatus has been known which has a Web browser program for connecting to a communication network such as the Internet so that Web pages can be browsed (the second prior art).

This electronic musical apparatus is configured such that the Web browser program generates a display image for displaying a browser function-related screen based on image data received from a Web site, and causes a display controller such as a display driver to display the generated display image on a display.

When the Web browser program performs image generation, the CPU of the electronic musical apparatus operates. Due to requirements for e.g. cost reduction, the CPU of the electronic musical apparatus generally has a lower processing capability and a smaller memory capacity as compared with the CPU of a personal computer, for example.

Also, a Web browser used in e.g. a personal computer usually has a so-called history function of storing a history comprised of a plurality of Web pages which have been visited via e.g. the Internet so that the Web pages visited in the past can be easily accessed again. History pages to be displayed can be usually changed using "Back" and "Next" buttons.

The electronic musical apparatus according to the first prior art, however, has the problem that when the musical instrument function-related pages and the Web pages are selectively displayed using the same display screen, if musical instrument function-related pages and history pages of Web pages are changed using different operators, the user has to learn how to operate each operator.

By the way, it is ordinarily configured such that musical instrument function-related pages are sequentially changed in two directions such as the horizontal direction and the vertical direction, and history pages of Web pages are changed forward ("Next") and backward ("Back") in terms of time. The musical instrument function-related pages and the history pages are changed using operating systems which are conceptionally similar to each other, and hence there is room for improvement in realizing an apparatus with improved userfriendliness by making it easier for the user to learn how to operate the apparatus.

On the other hand, the electronic musical apparatus according to the second prior art has the problem that the speed at which the browser-function related screen is displayed is not high since the CPU has a relatively low processing capability as mentioned above.

SUMMARY OF THE INVENTION

It is a first object of the present invention to provide an electronic musical apparatus in which operators for changing pages on a musical instrument function-related screen and history pages on a Web screen are shared, so that those pages can be changed using similar operating systems to improve the userfriendliness, as well as a program for controlling the electronic musical apparatus.

It is a second object of the present invention to provide an electronic musical apparatus which reduces processing burdens on a Web browser to increase the speed at which a browser function-related screen is displayed, as well as a program for controlling the electronic musical apparatus.

To attain the above first object, in a first aspect of the present invention, there is provided an electronic musical apparatus comprising a display controller that causes a display to selectively display a musical instrument function-related screen comprising a plurality of pages generated based on display data stored in advance in the electronic musical apparatus or a Web screen comprising history pages generated based on data obtained via a communication network, a first operator for giving an instruction for changing the pages of the musical instrument function-related screen displayed by the display in a first direction, and a second operator for giving an instruction for changing the pages of the musical instrument function-related screen displayed by the display in a second direction, wherein the display controller is operable when the Web screen is displayed by the display, to change the history pages of the Web screen forward in terms of time in response to operation of the first operator, and the display controller is operable when the Web screen is displayed by the display, to change the history pages of the Web screen backward in terms of time in response to operation of the second operator.

According to this arrangement, the first and second operators are shared to change the pages of the musical instrument function-related screen and the history pages of the Web screen.

Preferably, the electronic musical apparatus further comprises the display.

Preferably, the electronic musical apparatus further comprises a third operator for selectively designating the musical instrument function-related screen or the Web screen, and the musical instrument function-related screen or the Web screen is selectively displayed by the display when the third operator is operated.

Preferably, both the first operator and the second operator comprise physical operators.

To attain the first object, in a second aspect of the present invention, there is provided a program executed by a computer, for controlling an electronic musical apparatus comprising a first operator and a second operator, comprising a display control module for causing a display to selectively display a musical instrument function-related screen comprising a plurality of pages generated based on display data stored in advance in the electronic musical apparatus or a Web screen comprising history pages generated based on data obtained via a communication network, according to screen display modes including at least a first mode in which the musical instrument function-related screen is displayed and a second mode in which the Web screen is displayed, a mode determining module for determining whether a present screen display mode is the first mode or the second mode, an operation accepting module for accepting operations of the first and second operators, and a change instructing module operable when an operation of one of the first operator and the second operator is accepted by the operation accepting module while the mode determining module determines that the present screen display mode is the first mode, to instruct the display control module to change the pages of the displayed musical instrument function-related screen displayed by the display in one of a first direction and a second direction corresponding to the one operator, and operable when an operation of one of the first operator and the second operator is accepted by the operation accepting module while the mode determining module determines that the present screen display mode is the second mode, to instruct the display control module to change the history pages of the Web screen displayed by the display in one of a forward direction and a backward direction corresponding to the one operator, in terms of time.

According to this arrangement, the pages of the musical instrument function-related screen can be changed in the first mode, and the history pages of the Web screen can be changed in the second mode, according to operations of the first and second operators.

To attain the second object, in a third aspect of the present invention, there is provided an electronic musical apparatus comprising a display controller that causes a display to display a browser function-related screen, a browser functional section that generates a first display image for displaying a part of the browser function-related screen based on image data received from a Web site on a communication network, a data storage device that stores predetermined element image data corresponding to another part of the browser function-related screen, identification information for identifying the predetermined element image data, and arrangement information indicative of a display position of the predetermined element image data in a manner being associated with each other, and a data supply device that supplies the identification information and the arrangement information stored by the data storage device to the browser functional section, and supplies the predetermined element image data identified by the identification information to the display controller, wherein the browser functional section supplies the identification information and the arrangement information supplied from the data supply device, to the display controller, and the display controller generates a second display image for displaying the other part of the browser function-related screen based on the predetermined element image data supplied from the data supply device and the identification information and the arrangement information supplied from the browser functional section, corresponding to the predetermined element image data, and causes the display to display the second display image together with the first display image generated by the browser functional section.

According to this arrangement, the second display image for displaying the other part of the browser function-related screen is generated by the display controller, not by the browser functional section, and hence the processing burdens on the browser functional section can be reduced.

Preferably, the browser functional section is capable of handling only image data in a format with a data capacity not less than a first data format, the display controller is capable of handling a second data format with a smaller data capacity than the first data format, the image data received from the Web site is formed in a data format with a data capacity not less than the first data format, and the element image data stored by the data storage device is formed in the second data format.

Preferably, the display controller is capable of causing the display to display a musical instrument function-related screen generated based on display data stored in advance in the electronic musical apparatus, and the display controller causes the display to selectively display the browser function-related screen and the musical instrument function-related screen.

Preferably, the electronic musical apparatus is capable of accessing the Web site via the communication network, the display comprises a main display area and a sub display area, the display controller causes the display to display the first display image in the main display area of the display according to a Web site which the electronic musical apparatus has accessed, and the display controller causes the display to fixedly display the second display image in the sub display area of the display irrespective of a Web site which the electronic musical apparatus has accessed.

Preferably, the data storage device comprises a read only memory.

To attain the above second object, in a fourth aspect of the present invention, there is provided a program executed by a computer, for controlling an electronic musical apparatus, comprising a display control module for causing a display to display a browser function-related screen, a browser function module for generating a first display image for displaying a part of the browser function-related screen based on image data received from a Web site on a communication network, a data storing module storing predetermined element image data corresponding to another part of the browser function-related screen, identification information for identifying the predetermined element image data, and arrangement information indicative of a display position of the predetermined element image data in a manner being associated with each other, and a data supplying module for supplying the identification information and the arrangement information stored by the data storage module to the browser functional module, and supplying the predetermined element image data identified by the identification information to the display control module, wherein the browser function module supplies the identification information and the arrangement information supplied from the data supplying module, to the display control module, and the display control module generates a second display image for displaying the other part of the browser function-related screen based on the predetermined element image data supplied from the data supplying module and the identification information and the arrangement information supplied from the browser function module, corresponding to the predetermined element image data, and causes the display to display the second display image together with the first display image generated by the browser function module.

A computer-readable storage medium storing the above program constitutes a fifth or sixth aspect of the present invention.

The above and other objects, features, and advantages of the invention will become more apparent from the following detailed description taken in conjunction with the accompanying drawings.

BRIEF DESCRIPTION OF THE DRAWINGS

FIG. 6 is a view showing a table which specifies the relationship between screen display modes and the functions of operated switches.

DETAILED DESCRIPTION OF THE PREFERRED EMBODIMENTS

The present invention will now be described in detail with reference to the drawings showing a preferred embodiment thereof.

Figure 1:
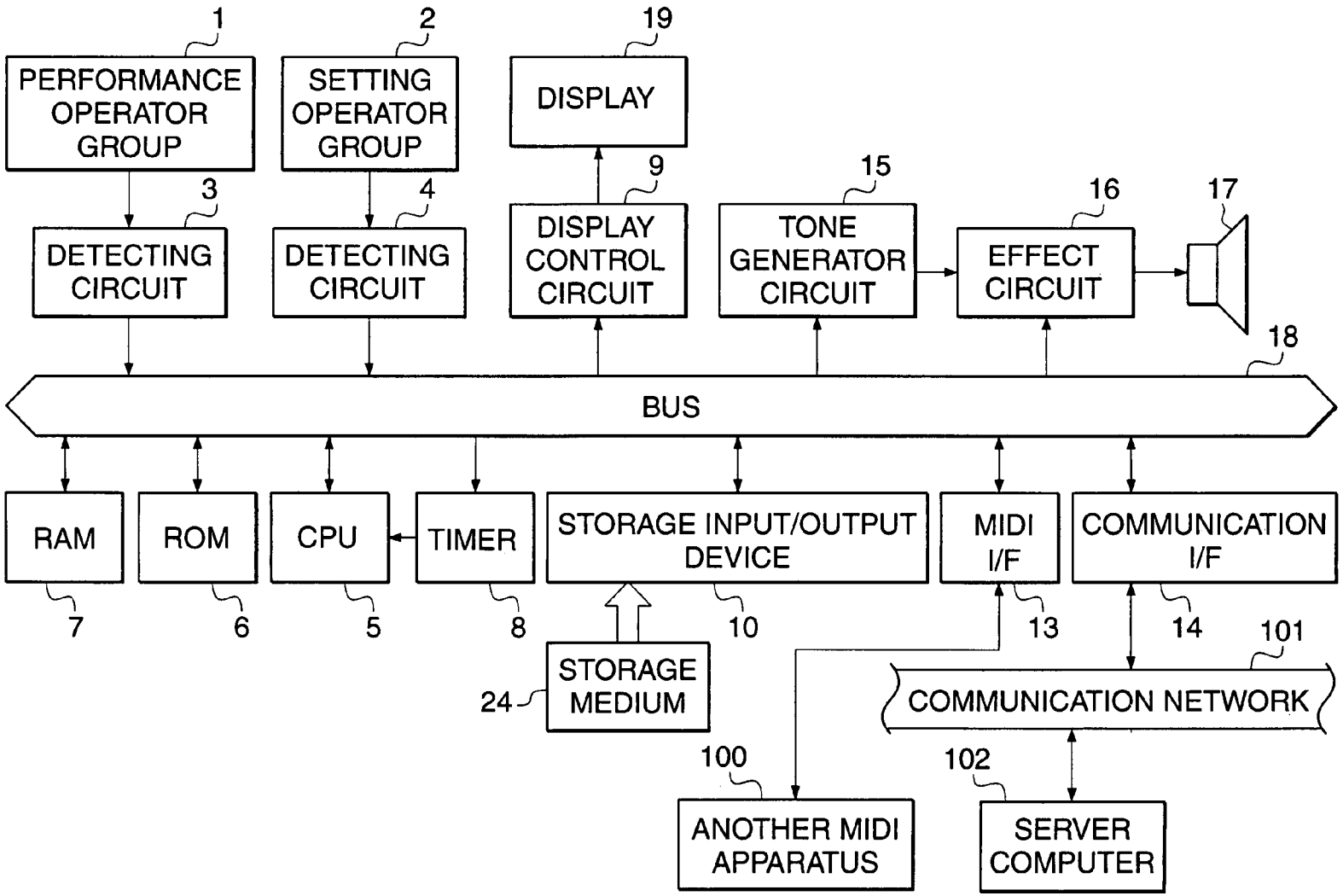
FIG. 1 is a block diagram showing the overall construction of an electronic musical apparatus according to an embodiment of the present invention.

FIG. 1 is a block diagram showing the overall construction of an electronic musical apparatus according to an embodiment of the present invention.

The electronic musical apparatus according to the present embodiment is implemented by e.g. an electronic keyboard instrument, and is comprised of a detecting circuit 3, a detecting circuit 4, a ROM (Read Only Memory) (data storage device) 6, a RAM (Random Access Memory) 7, a timer 8, a display control circuit 9, a storage input/output device 10, a MIDI interface (MIDI I/F) 13, a communication interface (communication I/F) 14, a tone generator circuit 15, and an effect circuit 16, all of which are connected to a CPU (data supply device) 5 via a bus 18.

A performance operator group 1 comprised of a plurality of keys, not shown, are connected to the detecting circuit 3, and a setting operator group 2 for inputting various pieces of information, comprised of setting switches are connected to the detecting circuit 4. A display 19 such as an LCD (Liquid Crystal Display) is connected to the display control circuit 9. The timer 8 is connected to the CPU 5, and a server computer 102 such as a Web server is connected to the communication I/F 14 via a communication network 101 such as a wired or wireless LAN (Local Area Network), the Internet, or a telephone line. A sound system 17 is connected to the tone generator circuit 15 via the effect circuit 16.

The detecting circuit 3 detects the operative state of the performance operator group 1, and the detecting circuit 4 detects the operative state of the setting operator group 2. The CPU 5 controls the overall operation of the electronic musical apparatus. The ROM 6 stores control programs to be executed by the CPU 5, various driver programs, various table data, and so forth. The RAM 7 temporarily stores various input information such as performance data and text data, various flags, buffer data, operation results, and so forth. The timer 8 measures various times such as an interrupt time in a timer interrupt process. The display control circuit 9 causes the display 19 to display various information such as a musical score, a Web page (Web screen), and various setting screens related to musical instrument functions.

The storage input/output device 10 is comprised of a hard disk drive (HDD), a CD-ROM (Compact Disk-Read Only Memory) drive, a magneto-optical disk (MO) drive, a DVD drive, a semiconductor memory, and so forth, and is capable of driving a portable storage medium 24 such as a floppy (registered trademark) disk. The storage input/output device 10 is capable of storing control programs to be executed by the CPU 5; if one or more control programs are not stored in the ROM 6, the control program(s) is(are) stored in the storage input/output device 10 and loaded into the RAM 7 so that the CPU 5 can operate in the same manner as in the case where the control program(s) is(are) stored in the ROM 6. This facilitates the addition of control programs and the version upgrade.

The MIDI I/F 13 provides interface for sending and receiving a MIDI (Musical Instrument Digital Interface) signal to and from another MIDI apparatus 100. The tone generator circuit 15 converts performance data, which is input via e.g. the MIDI I/F 13, into a musical tone signal. The effect circuit 16 applies various effects to a musical tone signal input from the tone generator circuit 15. The sound system 17, which is comprised of a DAC (Digital-to-Analog Converter), an amplifier, a speaker, and so forth, converts a musical tone signal or the like, which is input from the effect circuit 16, into sound.

Figure 2:
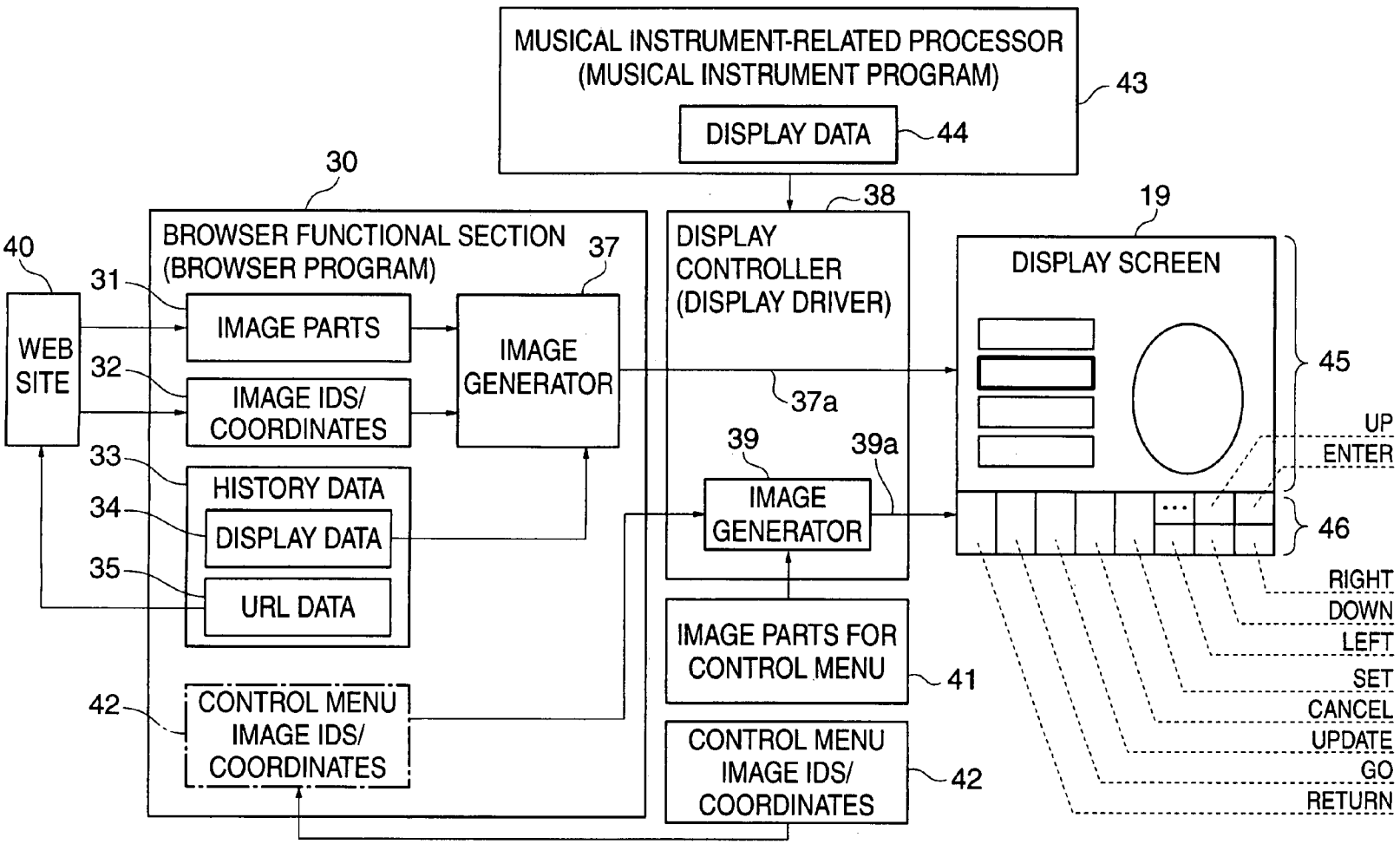
FIG. 2 is a block diagram showing an arrangement for realizing a display function of the electronic musical apparatus in FIG. 1.

FIG. 2 is a block diagram showing an arrangement for realizing a display function of the electronic musical apparatus. As shown in FIG. 2, the electronic musical apparatus is comprised of functional sections such as a browser functional section 30, a display controller 38, and a musical instrument-related processor 43. The electronic musical apparatus has a Web browser program, a display driver program (hereinafter referred to as "the display driver"), a musical instrument program, and a musical instrument UI (user interface) program, which are stored in e.g. the ROM 6, or may be stored in the hard disk of the storage input/output device 10.

The functions of the browser functional section 30 described below are realized by the CPU 5 in cooperation with the ROM 6, RAM 7, storage input/output device 10, and so forth in accordance with the above-mentioned Web browser program. Similarly, the functions of the display controller 38 are realized by the CPU 5 in cooperation with the ROM 6, RAM 7, display control circuit 9, and so forth in accordance with the above-mentioned display driver and musical instrument UI program. The functions of the musical instrument-related processor 43 associated with display are realized by the CPU 5 in cooperation with the ROM 6, RAM 7, detecting circuit 4, and so forth in accordance with the above-mentioned musical instrument program and musical instrument UI program.

Figure 5:
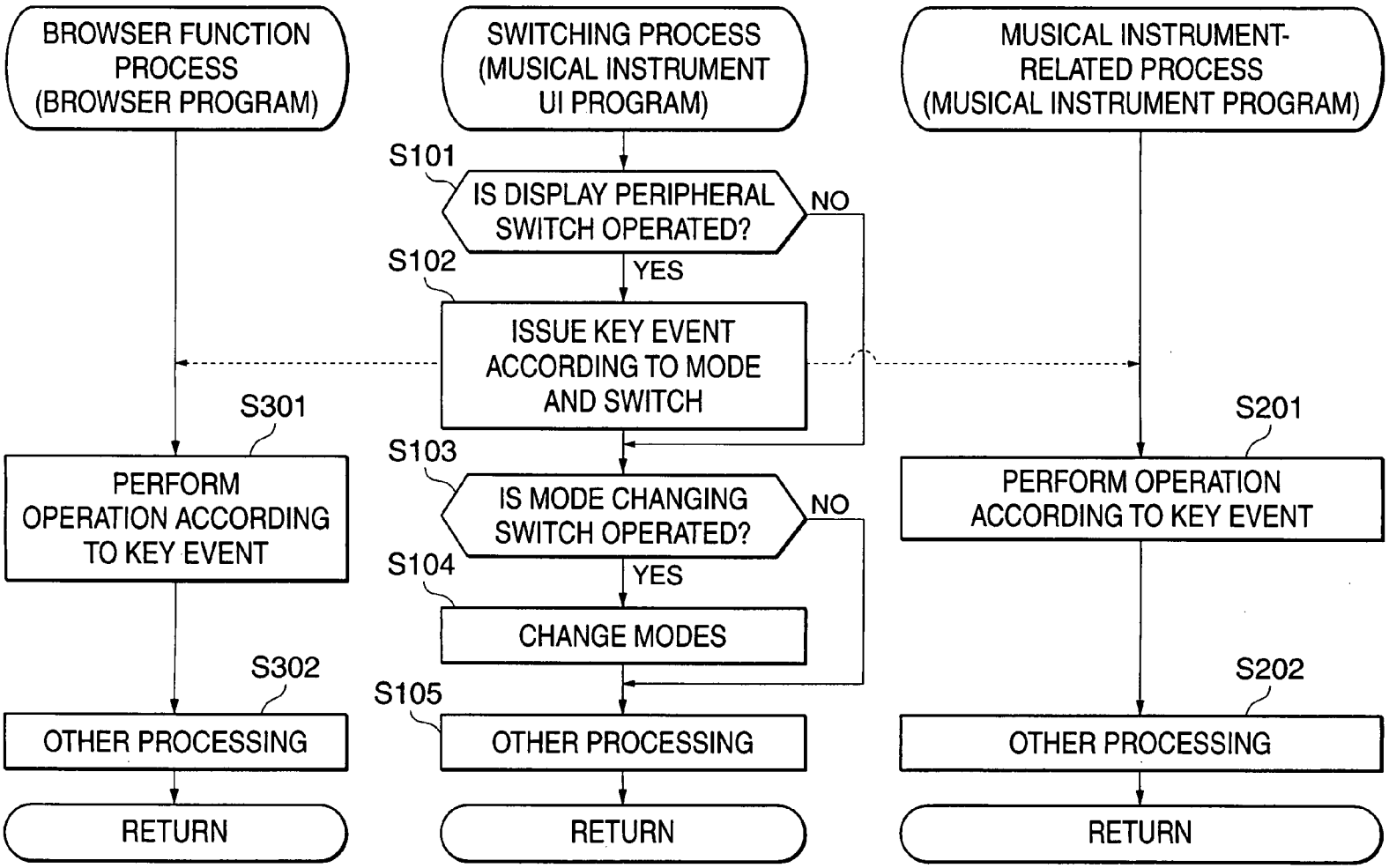
FIG. 5 is a flow chart showing a switching process carried out in accordance with a musical instrument UI program as well as a browser function process carried out in accordance with a Web browser program and a musical instrument-related process carried out in accordance with a musical instrument program.

In the electronic musical apparatus according to the present embodiment, the following two screen display modes can be selectively set by a switching process, described with reference to FIG. 5: a "musical instrument mode" (the first mode) in which a "musical instrument function-related page (musical instrument function-related screen)" such as a setting/selecting screen related to musical instrument functions is displayed on the display 19 mainly through processing performed by the musical instrument-related processor 43, and a "browser mode" (the second mode) in which a Web page (browser screen; Web screen) received via the communication network 101 is displayed on the display 19 mainly through processing performed by the browser functional section 30.

Figure 3:
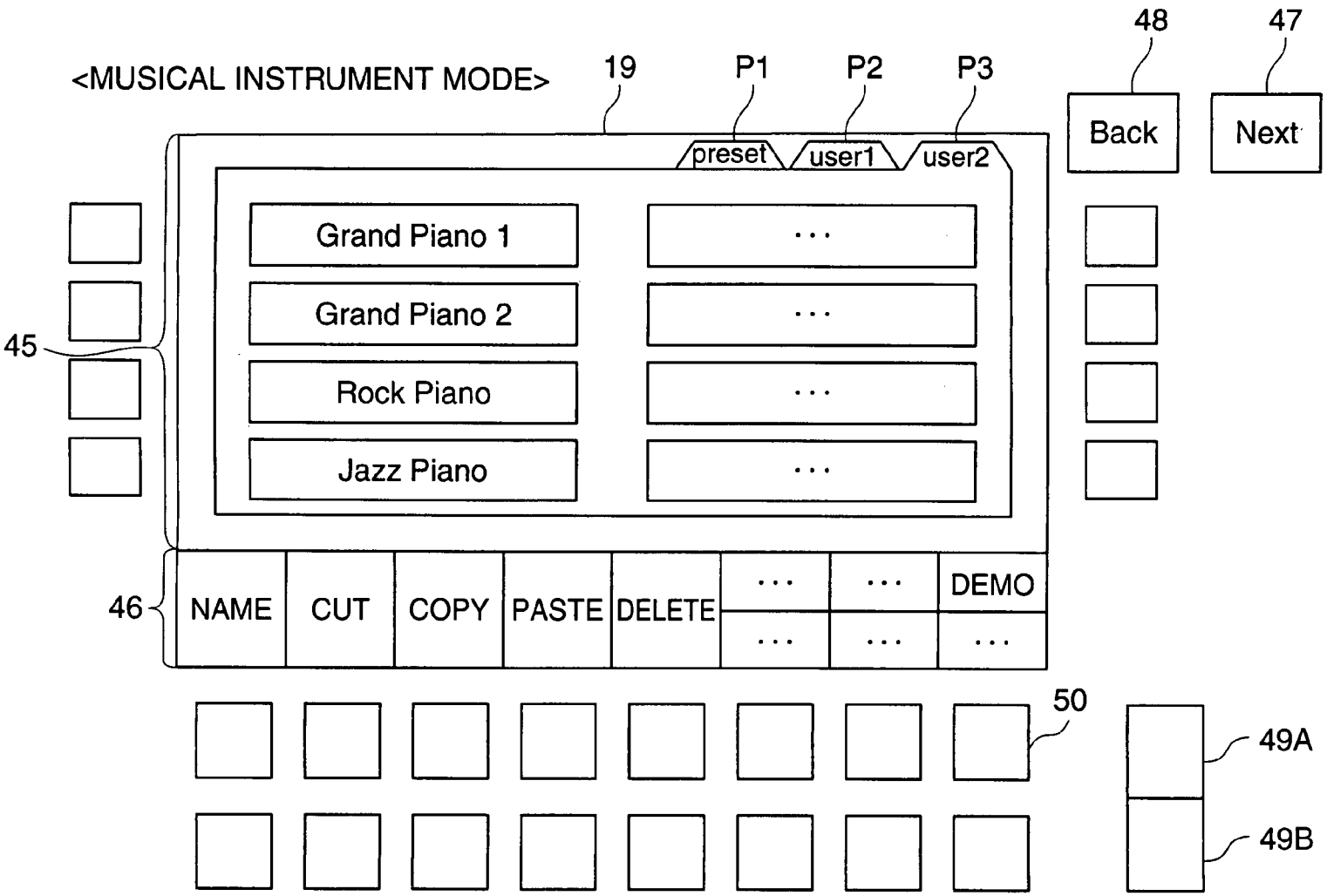
FIG. 3 is a view showing an example of a screen which is shown on a display in a musical instrument mode, as well as peripheral switches.
Figure 4:
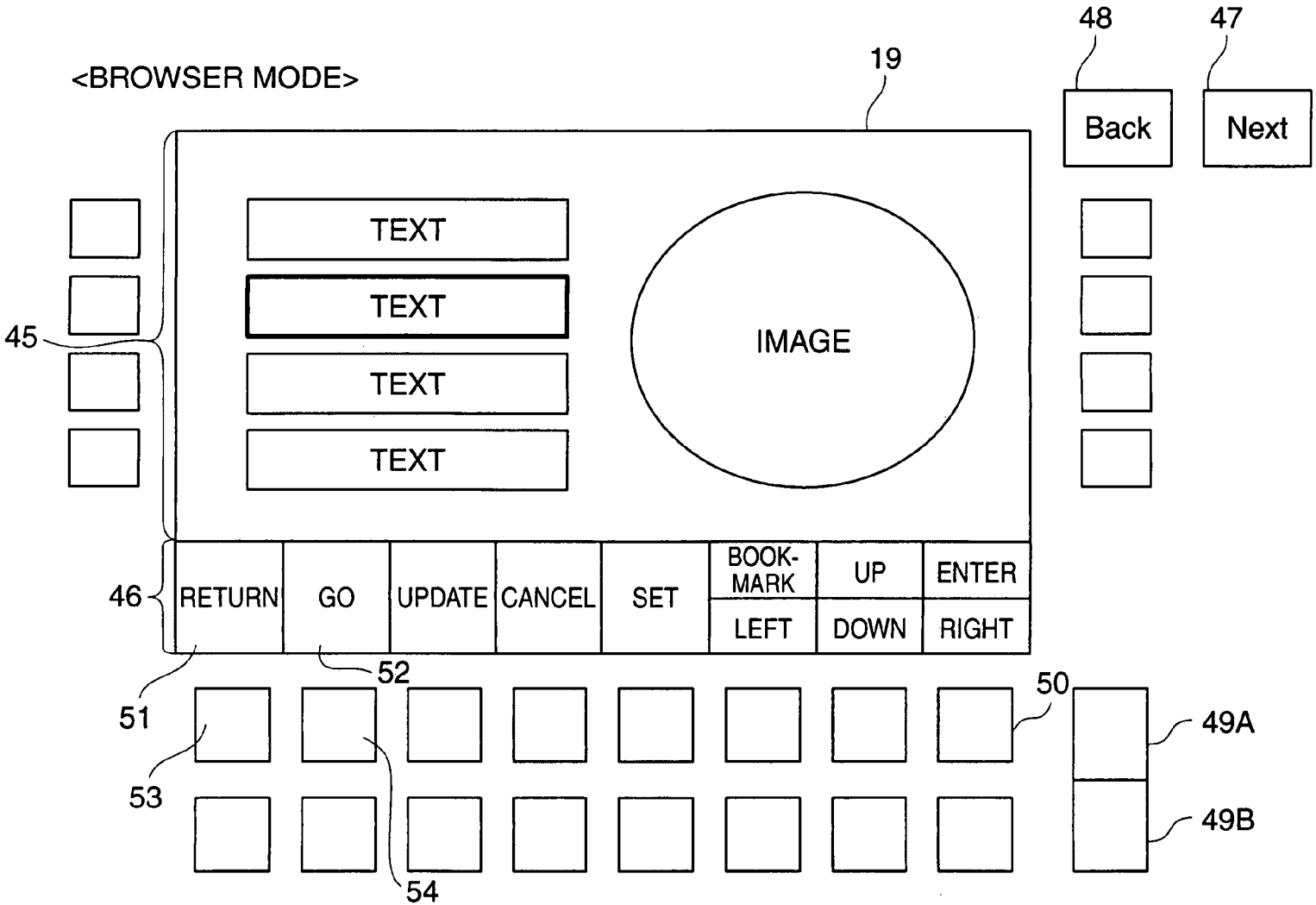
FIG. 4 is a view showing an example of a screen which is shown on the display in a browser mode, as well as peripheral switches.

FIG. 3 is a view showing an example of a screen which is displayed on the display 19 in the musical instrument mode, as well as peripheral switches. FIG. 4 is a view showing an example of a screen which is shown on the display 19 in the browser mode, as well as peripheral switches.

In the musical instrument mode, as shown in FIG. 2, the musical instrument-related processor 43 sends display data 44 to the display controller 38. The display data 44 is stored in advance in e.g. the ROM 6 of the electronic musical apparatus, and includes data for displaying a plurality of musical instrument function-related pages (musical instrument function-related screen). The display controller 38 generates an image based on the display data 44 and causes the display 19 to display the generated image. There are various kinds of display screens in the musical instrument mode; as for a tone color-selecting screen, as shown in the example of FIG. 3, tone color-selecting pages as musical instrument function-related pages consisting of a plurality of pages are displayed in a main display area 45 on the display screen of the display 19, and a fixed function menu such as "NAME" for setting a name and "DEMO" for demonstrating a tone color by sounding the same are displayed in a sub display area 46 outside the main display area 45 on the display screen of the display 19. The tone selecting pages consist of three pages: a preset page P1, a user1 page P2, and a user2 page P3. In the example shown in FIG. 3, the user2 page P3 is displayed.

Here, the main display area 45 constitutes "a part of a browser function-related screen", and the sub display area 46 constitutes "another part of a browser function-related screen".

By the way, switches such as a Next switch (first operator) 47, a Back switch (second operator) 48, mode changing switches (third operators) 49A and 49B, and other multi-function switches (such as a multi-function switch 50), all of which are physically operated, are arranged in the vicinity of the display 19. These switches are included in the setting operator group 2. The tone color selecting pages are changed using the Next switch 47 and the Back switch 47. In the case where the tone color selecting pages are displayed, they are sequentially changed rightward as viewed in FIG. 3 (the first direction) (page P1→page P2→page P3) by operating the Next switch 47, and changed leftward as viewed in FIG. 3 (the second direction) (page P3→page P2→page P1) by operating the Back switch 48. The mode changing switches 49A and 49B are used for changing the screen display mode to the musical instrument mode and the browser mode, respectively. The multi-function switches function differently according to screen display modes or display screens; for example, in the case where the tone color selecting pages are displayed, the multi-function switch 50 is used to listen to a tone color demonstration.

On the other hand, in the browser mode, the browser functional section 30 receives image parts (image data) 31 and image IDs/coordinates 32 corresponding to the image parts 31, which are required for displaying a Web page (Web screen), from a Web site 40 stored in e.g. the server computer 102 via the communication network (refer to FIG. 2), and causes the RAM 7 and the hard disk of the storage input/output device 10 to store the received image parts 31 and image IDs/coordinates 32. An image ID in the image IDs/coordinates 32 is information which identifies the corresponding image part 31, and coordinates in the image IDs/coordinates 32 are arrangement information indicative of the position where the image parts 31 should be displayed on the display screen. The arrangement information is not only information in its proper sense such as coordinates on a two-dimensional plane, but includes all pieces of information which specify the arrangement. Ordinarily, a large number of pairs of the image parts 31 and the image IDs/coordinates 32 are used for displaying one Web page.

An image generator 37 of the browser functional section 30 generates a first display image 37*a*, which is to be displayed on the display 19, based on the image parts 31 and the image IDs/coordinates 32. The display controller 38 causes the first display image 37*a* to be displayed on the screen of the display 19. The first display image 37*a* is displayed in the main display area 45 as shown in FIGS. 2 and 4; what is displayed in the main display area 45 includes images, texts, and so forth.

In the ROM 6 for example, image parts for a control menu (hereinafter referred to as "the menu image parts") (predetermined element image data) 41 and control menu image IDs/coordinates (hereinafter referred to as "the menu image IDs/coordinates") (identification information/arrangement information) 42, which are shown in FIG. 2, are stored in the ROM 6 in a manner being associated with each other. They may be stored in the hard disk of the storage input/output device 10. Similarly to the above-mentioned image IDs/coordinates 32, an image ID in the menu image IDs/coordinates 42 identifies the corresponding menu image parts 41, and coordinates in the menu image IDs/coordinates 42 specifies the position at which the menu image parts 41 should be displayed.

The menu image IDs/coordinates 42 are supplied to the browser functional section 30, and the corresponding menu image parts 41 are supplied to the display controller 38. The browser functional section 30 sends the supplied menu image IDs/coordinates 42 to the display controller 38. Therefore, the browser functional section 30 never receives the menu image parts 41, and thus does not perform image generation based on the menu image parts 41. An image generator 39 of the display controller 38 generates a second display image 39*a*, which is to be displayed on the display 19, based on the supplied menu image parts 41 and menu image IDs/coordinates 42. The display controller 38 causes the second display image 39*a* to be displayed on the display screen of the display 19. The second display image 39*a* is displayed in the sub display area 46 as shown in FIGS. 2 and 4.

As shown in FIG. 4, a function menu of "Return" 51, "Go" 52 and so forth is displayed in the sub display area 46. In this way, the first display image 37*a* to be displayed in the main display area 45 is generated by the browser functional section 30, while the second display image 39*a* to be displayed in the sub display area 46 is generated by the display controller 38, and both the display images 37*a* and 39*a* are displayed on the display 19, so that a browser screen as shown in FIG. 4 is displayed.

Unlike the main display area 45, the contents displayed on the sub display area 46 are not changed according to accessed Web sites, but fixed in the browser mode. Therefore, in the sub display area 46 on which displayed contents are hardly changed, the display controller 38 directly draws images to reduce processing burdens on the browser functional section 30.

By the way, in the present embodiment, the format of image data which can be handled by the browser functional section 30 (or the above-mentioned Web browser program) is limited to a data format with a predetermined data capacity (for example, in the form of a full-color image of 24 bits) (hereinafter referred to as "the first data format") or a predetermined data format with a larger data capacity. On the other hand, the display controller 38 (or the display driver) is adapted to handle at least a data format with a smaller data capacity than the first data format (for example, in the form of a 16-bit color image) (hereinafter referred to as "the second data format"). The image parts 31 are formed in the first data format, and the menu image parts 41 are formed in the second data format. This prevents an increase in the memory capacity of e.g. the ROM 6 which stores the menu image parts 41, and reduces processing burden on the display controller 38. In the present embodiment, NetFront (registered trademark) produced by ACCESS Co., Ltd. is used as the Web browser program, but this is not limitative.

By the way, the Web browser program has a "history function" of easily accessing Web sites which were visited in the past. To display a history, the browser functional section 30 stores history data 33 in e.g. the hard disk of the storage input/output device 10. There are two modes in which the history data 33 is stored; in one mode, display data 34 including all the displayed contents is stored, and in the other mode, URL data 35 including only information indicative of URLs (Uniform Resource Locators) is stored (refer to FIG. 2).

The display data 34 includes information corresponding to the image parts 31 and the image IDs/coordinates 32. In the case where a history page is displayed based on the display data 34, the image generator 37 generates the first display image 37*a* based on the display data 34, and the display controller 38 causes the display 19 to display the first display image 37*a*, as in the case where a Web page is based on the image parts 31 and the image IDs/coordinates 32. On the other hand, in the case where a history page is displayed based on the URL data 35, the image parts 31 and the image IDs/coordinates 32 are sent from the Web site 40 to the browser functional section 30 in response to the transmission of the URL data 35 to the Web site 40. Thereafter, as described above, the image generator 37 generates the first display image 37*a*, so that a desired history page is displayed on the display 19. Such a history page displaying process is carried out in accordance with a history displaying instruction, described later.

A description will now be given of operations in the browser mode. As shown in FIG. 4, multi-function switches 53 and 54 are arranged just below the function menu such as "Return" 51 and "Go" 52. In the browser mode, the Next switch 47 and the Back switch 48 function in the same manner as the multi-function switches 54 and 53, for giving a history displaying instruction in a manner corresponding to the "Next" 52 and "Return" 51. That is, when the Next switch 47 is depressed, history pages to be displayed are sequentially changed forward in terms of time, and when the Back switch 48 is depressed, history pages to be displayed are sequentially changed backward (toward the past) in terms of time. In the browser mode, the multi-function switch 50 is used for giving an entering (setting) instruction.

A description will now be given of a concrete process for changing the above described various kinds of displays. FIG. 5 shows a flow chart of a switching process carried out in accordance with the musical instrument UI program as well as a flow chart of the browser function process carried out in accordance with the Web browser program and a flow chart of a musical instrument-related process carried out in accordance with the musical instrument program. These processes are constantly carried out at regular time intervals while power supply to the electronic musical apparatus is on. FIG. 6 is a view showing a table which specifies the relationship between screen display modes and the functions of operated switches.

First, in the switching process, it is determined whether any of display peripheral switches has been operated or not (step S101). That is, whether any of the Next switch 47, the Back switch 48, the multi-function switches 50, 51, and 53, and so forth, except the mode changing switches 49A and 49B, has been operated or not. If it is determined that no display peripheral switch has been operated, it is then determined whether the mode changing switch 49A or 49B has been operated or not (step S103). If the mode changing switches 49A and 49B have not been operated, another processing is performed (step S105), followed by termination of the process.

On the other hand, if it is determined in the step S101 that any display peripheral switch has been operated, a key event corresponding to the present screen display mode and the operated switch is issued to instruct a program corresponding to the screen display mode to be activated (step S102). On the other hand, in a step S201 in the musical instrument-related process and a step S301 in the browser function process, an operation is performed in accordance with the issued key event.

Specifically, the peripheral switches function differently according to screen display modes; for example, in the musical instrument mode, the functions of the Back switch 48, the Next switch 47, and the multi-function switch 50 are set to "Shift to Left Adjacent Tab" (pages are changed leftward), "Shift to Right Adjacent Tab" (pages are changed rightward), and "Listen to Tone Color Demo", respectively, as shown in FIG. 6. Similarly, in the browser mode, they are set to "Return", "Go", and "Enter (Set)", respectively, as shown in FIG. 6. Also, the other multi-function switches are set to respective different functions according to screen display modes.

Therefore, for example, in the case where the Next switch 47 is operated in the musical instrument mode, a key event which indicates that e.g. tone color selecting pages are to be changed rightward is issued to the musical instrument-related processor 43. Then, in the step S201 in the musical instrument-related process, an operation is performed in accordance with the issued key event. That is, the musical instrument-related processor 43 sends necessary display data 44 to the display controller 38 so that e.g. tone color selecting pages can be changed rightward by only one page, and the display controller 38 causes the display 19 to display the resulting page (refer to FIG. 3).

In the step S102, for example, if the Next switch 47 is operated in the browser mode, a key event which indicates that history pages are to be changed forward (progressing direction) in terms of time is issued to the browser functional section 30. Then, in the step S301 in the browser function process, an operation is performed in accordance with the issued key event. That is, the image generator 37 of the browser functional section 30 generates the first display image 37*a* for changing pages based on the display data 34 so that history pages can be changed forward by only one page, and the display controller 38 causes the display 19 to display the first display image 37*a* (refer to FIG. 4). By the way, if history data is based on the URL data 35, pages to be displayed are changed in the same manner although it goes through the Web site 40 once.

If it is determined in the step S103 that the mode changing switch 49A or 49B has been operated, the screen display mode is changed according to this operation (step S104), and the above-mentioned step S105 is executed. In a step S202 in the musical instrument-related process, other processing such as a various screen displaying process in the musical instrument mode is performed. In a step S302 in the browser function process, other processing such as a browser screen displaying process in the browser mode is performed.

According to the present embodiment, a process for displaying a fixed menu on the sub display area 46 on the browser function-related screen is carried out by the display controller 38, not by the browser functional section 30. This reduces the amount of processing which should be performed by the browser functional section 30. Therefore, processing burdens on the browser functional section 30 can be reduced, and the speed at which the browser function-related screen is displayed can be increased, as compared with the case where the browser functional section 30 carries out all the processes for displaying the browser function-related screen.

Also, the menu image parts 41 for displaying a fixed menu in the sub display area 46 on the browser function-related screen are formed in a data format with a smaller data capacity as compared with the image parts 31 for display in the main display area 45. Therefore, not only the memory capacity required for storing the menu image parts 41 can be reduced, but also the data capacity to be handled as a whole can be decreased as compared with the case where image parts for displaying images in both the sub display area 46 and the main display area 45 are formed in a data format with a large data capacity. This further reduces processing burdens to increase the display speed.

Further, according to the present embodiment, the Next switch 47 and the Back switch 48 are shared to change pages on the musical instrument function-related screen and history pages on the Web screen, and this improves the userfriendliness since those pages can be changed using similar operational systems. Also, the arrangement can be simplified as compared with the case where physical switches for changing those pages are separately provided.

In the present embodiment, the data format of the menu image parts 41 should not be limited to a 16-bit color image format, but may be any data format which can be handled by the display controller 38 and has a smaller capacity than the minimum capacity that can be handled by the browser functional section 30.

Further, switches shared to change pages on the musical instrument function-related screen and history pages on the Web screen should not be limited to physical switches such as the Next switch 47 and the Back switch 48, but may be so-called soft switches shown on the display 19. Also, the names and designs of such switches should not be limited to "Next" and "Back", but may be marks such as "→" and "←".

The present invention may also be applied to the case where other function switches which are similar to each other in operational systems are shared to change pages on the musical instrument function-related screen and history pages on the Web screen.

The screen display modes should not necessarily be changed using the mode changing switches 49A and 49B, but may be changed through other operations such as switching operations which are performed to execute a musical instrument-related function or a browser function.

Although in the present embodiment, the electronic musical apparatus is provided with a plurality of keys (electronic keyboard instrument), this is not limitative, but for example, a stringed instrument, a wind instrument, or a percussion instrument may be used. The functional sections such as a display functional section and a performance functional section should not necessarily be incorporated into one unit, but one electronic musical system may be constructed of such functional sections which are configured as separate bodies and connected to each other using communication apparatuses such as a MIDI, and various kinds of networks.

Further, the electronic musical apparatus which realizes the present invention should not necessarily be an electronic musical instrument, but may be a portable apparatus provided with a CPU, application software, and so forth; for example, a karaoke machine, a game machine, a portable communication terminal device such as a cellular phone, and a portable piano. In the case where the present invention is applied to a portable communication terminal device, it should not be necessarily configured such that predetermined functions are completed only by the terminal device, but part of the functions may be assigned to a server so that a system comprised of the terminal device and the server can realize the functions of the present invention.

It is to be understood that the object of the present invention may also be accomplished by supplying a system or an apparatus with a storage medium in which a program code of software which realizes the functions of the above described embodiment is stored, and causing a computer (or the CPU or an MPU) of the system or apparatus to read out and execute the program code stored in the storage medium.

In this case, the program code itself read from the storage medium realizes the functions of the above described embodiment, and hence the program code and a storage medium on which the program code is stored constitute the present invention. Also, in the case where the program code is supplied via a transmission medium or the like, the program code itself constitutes the present invention.

Examples of the storage medium for supplying the program code include a floppy (registered trademark) disk, a hard disk, a magnetic-optical disk, a CD-ROM, a CD-R, a CD-RW, a DVD-ROM, a DVD-RAM, a DVD-RW, a DVD+RW, a magnetic tape, a nonvolatile memory card, and a ROM. Alternatively, the program is supplied by downloading via a network.

Further, it is to be understood that the functions of the above described embodiment may be accomplished not only by executing the program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into a memory provided on an expansion board inserted into a computer or a memory provided in an expansion unit connected to the computer and then causing a CPU or the like provided in the expansion board or the expansion unit to perform a part or all of the actual operations based on instructions of the program code.

What is claimed is:

1. An electronic musical apparatus comprising:

a display controller that causes a display to selectively display, in a first display mode, a musical instrument function-related screen comprising a plurality of pages generated based on display data stored in advance in the electronic musical apparatus and, in a second display mode, a Web screen comprising history pages generated based on data obtained via a communication network;

a first operator for instructing the display controller to change the pages of the musical instrument function-related screen displayed by the display in a first direction when the musical instrument function-related screen is displayed in the first display mode, and the history pages of the Web screen forward in terms of history when the Web screen is displayed in the second display mode; and a second operator for instructing the display controller to change the pages of the musical instrument function-related screen displayed by the display in a second direction when the musical instrument function-related screen is displayed in the first display mode, and to change the history pages of the Web screen backward in terms of history when the Web screen is displayed in the second display mode.

2. An electronic musical apparatus according to claim 1, further comprising the display.

3. An electronic musical apparatus according to claim 1, further comprising a third operator for selecting the musical instrument function-related screen in the first display mode and the Web screen in the second display mode.

4. An electronic musical apparatus according to claim 1, wherein each of said first operator and said second operator comprises a physical operator.

5. A computer-readable medium storing a computer program for controlling an electronic musical apparatus comprising a first operator and a second operator, the computer program comprising instructions for:

selectively displaying in a first display mode when a musical instrument function-related screen comprising a plurality of pages generated based on display data stored in advance in the electronic musical apparatus is displayed on a display and in a second display mode when a Web screen comprising history pages generated based on data obtained via a communication network is displayed on the display;

determining whether the display is in the first display mode or the second display mode;

accepting operations of the first and second operators; and changing the pages of the displayed musical instrument function-related screen when the display is in the first display mode and the history pages of the Web screen when the display is in the second display mode, changing when the first operator is accepted, in the first display mode, the pages of the displayed musical instrument function-related screen displayed by the display in a first direction, and in the second display mode, the history pages of the Web screen displayed by the display in a forward direction in terms of history, and changing when the second operator is accepted, in the first display mode, the pages of the displayed musical instrument function-related screen displayed by the display in a second direction, and in the second display mode, the history pages of the Web screen displayed by the display in a backward direction in terms of history.

6. An electronic musical apparatus comprising:

a display controller that displays a browser function-related screen on a display;

a browser functional section that generates a first display image for displaying a part of the browser function-related screen based on image data received from a Web site on a communication network; and a data storage device that stores predetermined element image data corresponding to another part of the browser function-related screen, identification information for identifying the predetermined element image data, and arrangement information indicative of a display position of the predetermined element image data in a manner being associated with each other wherein said display controller generates a second display image for displaying the another part of the browser function-related screen based on the predetermined element image data and the identification information and the arrangement information, corresponding to the predetermined element image data, and displays the second display image together with the first display image on the display.

7. An electronic musical apparatus according to claim 6, wherein:

said browser functional section handles only image data in a format with a data capacity not less than a first data format;

said display controller handles a second data format with a smaller data capacity than the first data format;

the image data received from the Web site is formed in a data format with a data capacity not less than the first data format; and the element image data stored by said data storage device is formed in the second data format.

8. An electronic musical apparatus according to claim 6, wherein said display controller further causes the display to display a musical instrument function-related screen generated based on display data stored in advance in the electronic musical apparatus, wherein said display controller causes the display to selectively display the browser function-related screen or the musical instrument function-related screen.

9. An electronic musical apparatus according to claim 6, wherein:

the electronic musical apparatus accesses the Web site via the communication network;

the display comprises a main display area and a sub display area;

said display controller causes the display to display the first display image in the main display area of the display according to a Web site which the electronic musical apparatus has accessed; and said display controller causes the display to fixedly display the second display image in the sub display area of the display irrespective of a Web site which the electronic musical apparatus has accessed.

10. An electronic musical apparatus according to claim 6, wherein said data storage device comprises a read only memory.

11. A computer-readable medium storing a computer program for controlling an electronic musical apparatus, the program comprising instruction for:

displaying a browser function-related screen on a display;

generating a first display image for displaying a part of the browser function-related screen based on image data received from a Web site on a communication network;

storing predetermined element image data corresponding to another part of the browser function-related screen, identification information for identifying the predetermined element image data, and arrangement information indicative of a display position of the predetermined element image data in a manner being associated with each other; and generating a second display image for displaying the another part of the browser function-related screen based on the predetermined element image data and the identification information and the arrangement information, corresponding to the predetermined element image data, and displaying the second display image together with the first display image on the display.

* * * * *